US009929512B1

(12) United States Patent
Trout et al.

(10) Patent No.: US 9,929,512 B1
(45) Date of Patent: Mar. 27, 2018

(54) ELECTRICAL CONNECTOR HAVING SHIELDING AT THE INTERFACE WITH THE CIRCUIT BOARD

(71) Applicant: TYCO ELECTRONICS CORPORATION, Berwyn, PA (US)

(72) Inventors: David Allison Trout, Lancaster, PA (US); Justin Dennis Pickel, Hummelstown, PA (US); Timothy Robert Minnick, Enola, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/273,171

(22) Filed: Sep. 22, 2016

(51) Int. Cl.

| | |
|---|---|
| ***H01R 13/03*** | (2006.01) |
| ***H01R 13/6588*** | (2011.01) |
| ***H01R 13/652*** | (2006.01) |
| ***H01R 13/6595*** | (2011.01) |

(52) U.S. Cl.
CPC ..... *H01R 13/6588* (2013.01); *H01R 13/652* (2013.01); *H01R 13/6595* (2013.01)

(58) Field of Classification Search
CPC H01R 13/658; H01R 13/6585; H01R 23/688; H01R 13/6594; H01R 13/6587; H01R 13/6588
USPC ..... 439/607.05, 607.06–607.12
See application file for complete search history.

(56) References Cited

U.S. PATENT DOCUMENTS

| | | | | |
|---|---|---|---|---|
| 6,899,566 | B2 * | 5/2005 | Kline | H01R 13/514 439/108 |
| 7,530,846 | B1 * | 5/2009 | Chen | H01R 23/688 439/607.05 |
| 7,811,128 | B2 * | 10/2010 | Pan | H01R 23/688 439/607.03 |
| 8,398,431 | B1 * | 3/2013 | Whiteman, Jr. | H01R 13/6587 439/607.06 |
| 8,905,786 | B2 * | 12/2014 | Davis | H01R 13/6587 439/108 |
| 9,356,401 | B1 * | 5/2016 | Horning | H01R 13/6585 |
| 2012/0184140 | A1 * | 7/2012 | Davis | H01R 12/724 439/607.34 |

* cited by examiner

*Primary Examiner* — Abdullah Riyami
*Assistant Examiner* — Thang Nguyen

(57) ABSTRACT

A contact module includes a dielectric body holding signal contacts and a shield coupled to the dielectric body having grounding portions providing electrical shielding for the signal contacts. Each grounding portion includes a base edge generally coplanar with the base edges of the signal contacts and a compliant pin extending below the base edge. Each grounding portion includes a surface tab extending below the base edge to at least partially fill a space between the base edge of the grounding portion and a mounting surface of the circuit board such that the surface tab provides electrical shielding for the compliant pins of the signal contacts in the space between the base edge of the signal contact and the mounting surface of the circuit board.

20 Claims, 7 Drawing Sheets

ELECTRICAL CONNECTOR HAVING SHIELDING AT THE INTERFACE WITH THE CIRCUIT BOARD

BACKGROUND OF THE INVENTION

The subject matter herein relates generally to electrical connectors.

Some electrical systems utilize electrical connectors, such as header assemblies and receptacle assemblies, to interconnect two circuit boards, such as a motherboard and daughtercard. The electrical connectors include contacts having pins extending from a mounting end of the electrical connectors. The pins are through-hole mounted to the circuit board by loading the pins into plated vias in the circuit board. A pin spacer is typically provided that holds and positions the pins for press-fitting to the circuit board. The electrical connectors include electrical shielding extending along the signal contacts of the electrical connectors. However, conventional electrical connectors have a gap or space in the electrical shielding at the interface with the circuit board. For example, the shielding typically ends a distance above the top of the circuit board such that the shield does not interfere with or prevent full mounting of the electrical connector to the circuit board. The shielding may end at the bottom of the contact modules with a space being defined by the thickness of the pin spacer between the bottom of the shield and the top of the circuit board. The pins are largely unshielded in the space between the bottom of the contact modules and the top of the circuit board.

A need remains for a contact module having improved shielding, such as between the contact modules and the top of the circuit board.

BRIEF DESCRIPTION OF THE INVENTION

In one embodiment, a contact module is provided including a dielectric body having a mounting edge extending between first and second sides and signal contacts held by the dielectric body. The signal contacts have mounting portions extending from the mounting edge for termination to a circuit board. Each mounting portion has a base edge and a compliant pin extending below the base edge. The compliant pin is configured to be received in plated vias of the circuit board. A shield is provided at the first side of the dielectric body. The shield has grounding portions at the mounting edge of the dielectric body. Each grounding portion provides electrical shielding for the corresponding signal contacts. Each grounding portion includes a base edge and a compliant pin extending below the base edge. The base edge of the grounding portion is generally coplanar with the base edges of the mounting portions of the corresponding signal contacts. The compliant pin is configured to be received in a corresponding plated via of the circuit board. Each grounding portion includes a surface tab extending below the base edge to at least partially fill a space between the base edge of the grounding portion and a mounting surface of the circuit board such that the surface tab provides electrical shielding for the compliant pins of the signal contacts in the space between the base edge of the signal contact and the mounting surface of the circuit board.

In another embodiment, a contact module is provided including a dielectric body having a mounting edge extending between first and second sides and signal contacts held by the dielectric body. The signal contacts have mounting portions extending from the mounting edge for termination to a circuit board. The mounting portions include compliant pins configured to be received in plated vias of the circuit board. A shield is provided at the first side of the dielectric body. The shield has grounding portions at the mounting edge of the dielectric body. Each grounding portion provides electrical shielding for the corresponding signal contacts. Each grounding portion includes a compliant pin configured to be received in a corresponding plated via of the circuit board. Each grounding portion includes a compliant surface tab configured to face a mounting surface of the circuit board. The compliant surface tab is configured to be deflected against the mounting surface of the circuit board when interfering with the mounting surface as the contact module is press-mounted to the circuit board.

In another embodiment, an electrical connector is provided including a housing having a mating end and a back end opposite the mating end, contact modules arranged in a contact module stack received in and extending from the back end of the housing for termination to a circuit board, and a pin spacer arranged at a mounting end of the contact module stack between the mounting end and the circuit board. Each contact module includes a dielectric body having a mounting edge extending between first and second sides and signal contacts held by the dielectric body. The signal contacts have mounting portions extending from the mounting edge for termination to a circuit board. Each mounting portion has a base edge and a compliant pin extending below the base edge. The compliant pin is configured to be received in plated vias of the circuit board. A shield is provided at the first side of the dielectric body. The shield has grounding portions at the mounting edge of the dielectric body. Each grounding portion provides electrical shielding for the corresponding signal contacts. Each grounding portion includes a base edge and a compliant pin extending below the base edge. The base edge of the grounding portion is generally coplanar with the base edges of the mounting portions of the corresponding signal contacts. The compliant pin is configured to be received in a corresponding plated via of the circuit board. Each grounding portion includes a surface tab extending below the base edge. The pin spacer includes a top and a bottom with signal contact openings receiving the compliant pins of the signal contacts and ground contact openings receiving the compliant pins of the grounding portions. The pin spacer has ground contact pockets receiving corresponding surface tabs. The pin spacer has ledges surrounding the signal contact openings, the ground contact openings and the ground contact pockets. The base edge of each signal contact is supported by a corresponding ledge of the pin spacer. The base edge of each grounding portion is supported by a corresponding ledge of the pin spacer. The surface tabs extend below the ledge into the ground contact pocket to at least partially fill a space between the base edge of the grounding portion and a mounting surface of the circuit board.

DETAILED DESCRIPTION OF THE INVENTION

Figure 1:
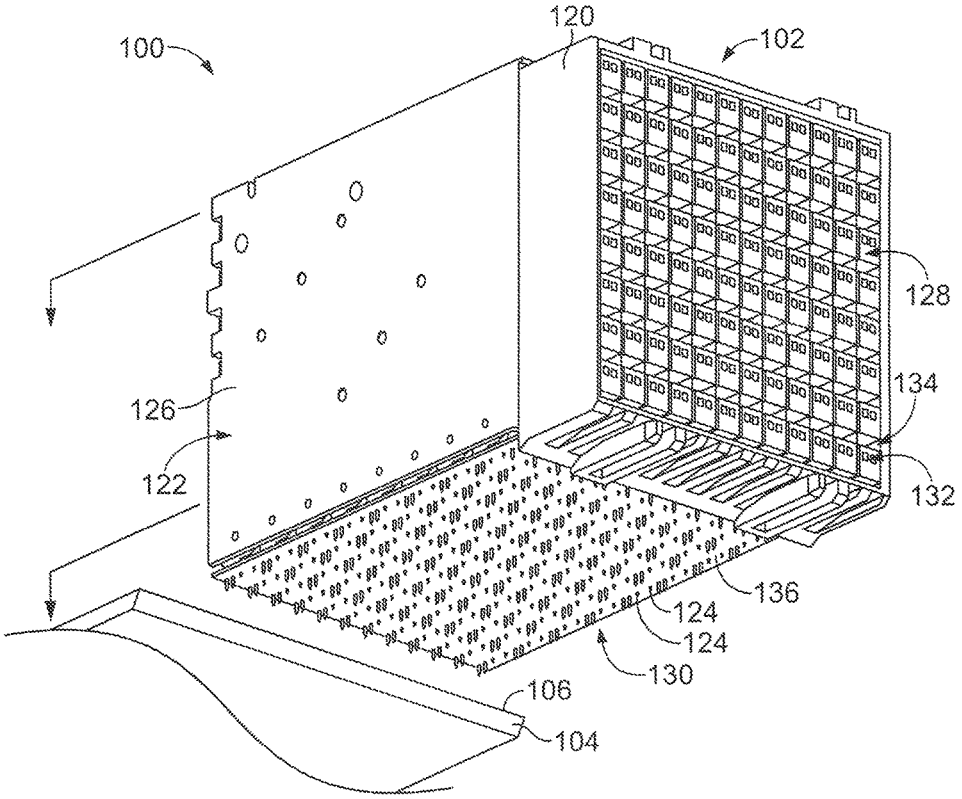
FIG. 1 is a front perspective view of an electrical connector system formed in accordance with an exemplary embodiment.
Figure 2:
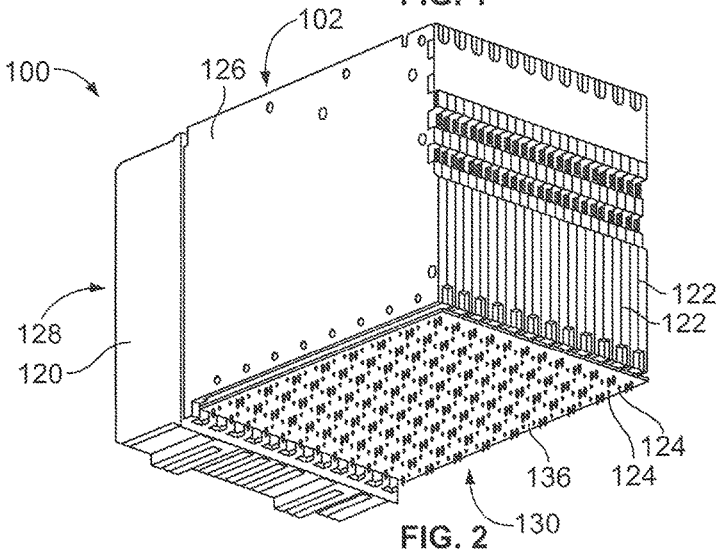
FIG. 2 is a rear perspective view of the electrical connector system.

FIG. 1 is a front perspective view of an electrical connector system 100 formed in accordance with an exemplary embodiment. FIG. 2 is a rear perspective view of the electrical connector system 100. The connector system 100 includes an electrical connector 102 configured to be mounted to a circuit board 104 (FIG. 1). FIG. 1 shows the electrical connector 102 poised for mounting to the circuit board 104. FIGS. 1 and 2 illustrate the bottom of the electrical connector 102 to illustrate the mounting side of the electrical connector 102. The electrical connector 102 is configured to be mated with a mating electrical connector, such as a header connector, which may also be mounted to a circuit board. For example, the mating electrical connector may be a STRADA Whisper backplane connector, commercially available from TE Connectivity. Various types of connector assemblies may be used in various embodiments, such as a right angle connector, a vertical connector or another type of connector.

The electrical connector 102 includes a housing 120 that holds a plurality of contact modules 122. The contact modules 122 are held in a stacked configuration generally parallel to one another. The contact modules 122 may be loaded into the housing 120 side-by-side in the stacked configuration as a unit or group. Any number of contact modules 122 may be provided in the electrical connector 102. The contact modules 122 each include a plurality of signal contacts 124 (shown in further detail in FIG. 3) that define signal paths through the electrical connector 102.

The electrical connector 102 includes a front 128 defining a mating end and a bottom 130 defining a mounting end. Optionally, the mounting end may be oriented substantially perpendicular to the mating end. The mating and mounting ends may be at different locations other than the front 128 and bottom 130 in alternative embodiments. The signal contacts 124 are received in the housing 120 and held therein at the mating end 128 for electrical termination to the mating electrical connector. The signal contacts 124 are arranged in a matrix of rows and columns. The signal contacts 124 within each column are provided within a respective same contact module 122. The signal contacts 124 within each row are provided in multiple, different contact modules 122. Other orientations are possible in alternative embodiments. Any number of signal contacts 124 may be provided in the rows and columns. Optionally, the signal contacts 124 may be arranged in pairs carrying differential signals; however other signal arrangements are possible in alternative embodiments, such as single ended applications. The signal contacts 124 extend through the electrical connector 102 from the mating end to the mounting end for mounting to the circuit board 104.

In an exemplary embodiment, each contact module 122 has a shield structure 126 for providing electrical shielding for the signal contacts 124. For example, the shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts 124. The contact modules 122 may provide shielding for each pair of signal contacts 124 along substantially the entire length of the signal contacts 124 between the mounting end and the mating end. In an exemplary embodiment, the shield structure 126 is configured to be electrically connected to the mating electrical connector and/or the circuit board 104. The shield structure 126 may be electrically connected to the circuit board 104 by features, such as grounding pins and/or surface tabs.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding mating signal contacts (for example, pins or blade contacts) of the mating electrical connector. The ground contact openings 134 receive mating ground contacts (for example, C-shaped ground shields) of the mating electrical connector therein. The ground contact openings 134 also receive portions of the shield structure 126 (for example, beams and/or fingers) of the contact modules 122 that mate with the mating ground contacts to electrically common the shield structure 126 with the mating electrical connector.

The housing 120 is manufactured from a dielectric material, such as a plastic material, and provides isolation between the signal contact openings 132 and the ground contact openings 134. The housing 120 isolates the signal contacts 124 from the shield structure 126. The housing 120 isolates each set (for example, differential pair) of signal contacts 124 from other sets of signal contacts 124.

The electrical connector 102 includes a pin spacer 136 provided at the bottom 130 of the electrical connector 102. The pin spacer 136 is used to hold the relative positions of the signal pins and ground pins for mounting to the circuit board 104. The pin spacer 136 includes pin openings 138 (shown in FIG. 9) being spaced apart in an array corresponding to a particular pinout of plated vias (not shown) in the circuit board 104 to which the electrical connector 102 is mounted. The pin spacer 136 is captured between the bottoms of the contact modules 122 and the circuit board 104 when the electrical connector 102 is mounted to the circuit board 104. In an exemplary embodiment, the pin spacer 136 receives portions of the shield structure 126 to provide electrical shielding for the signal pins in the space between the bottoms of the contact modules 122 and a mounting surface 106 of the circuit board 104. As such, the shielding structure 126 provides electrical shielding within the pin spacer 136 and possible entirely through the pin spacer 136 to the mounting surface 106 of the circuit board 104.

Figure 3:
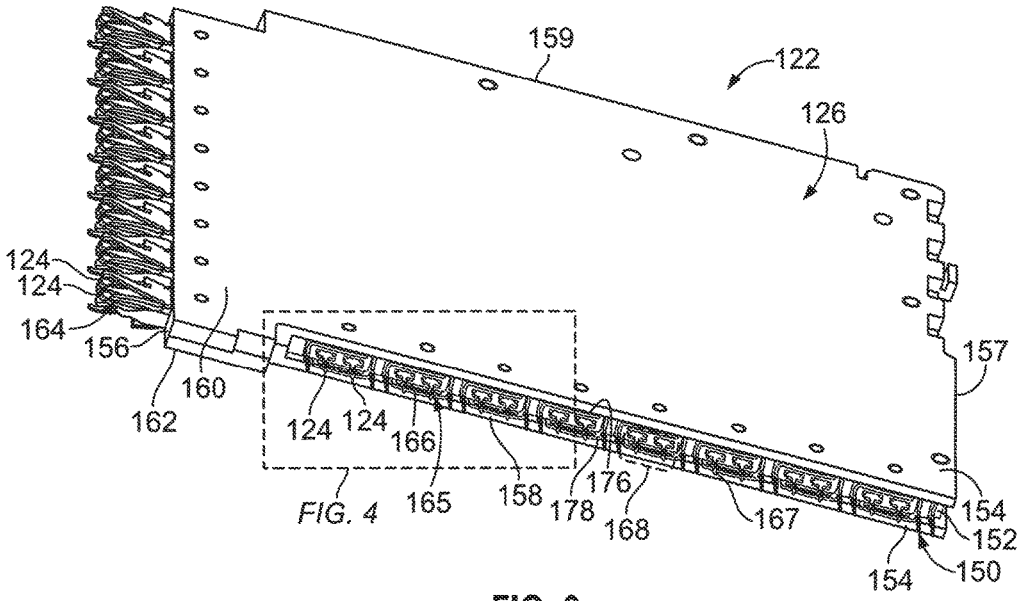
FIG. 3 is a bottom perspective view of a contact module of an electrical connector of the system in accordance with an exemplary embodiment.
Figure 4:
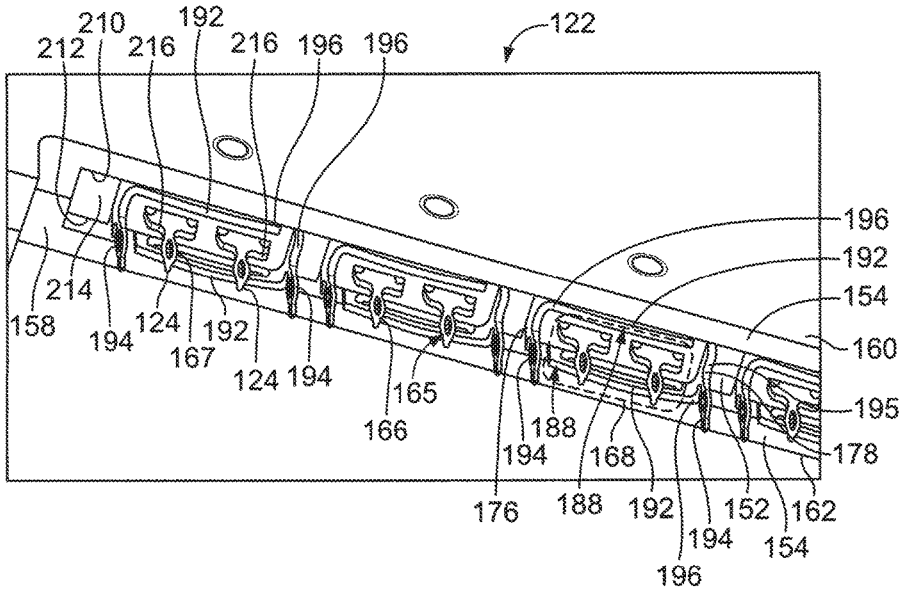
FIG. 4 is an enlarged view of one of the contact modules.

FIG. 3 is a bottom perspective view of one of the contact modules 122 in accordance with an exemplary embodiment. FIG. 4 is an enlarged view of one of the contact modules 122 identified by the area 4-4 shown in FIG. 3. The contact module 122 includes a frame assembly 150 having a lead-frame defining the signal contacts 124 and a dielectric body 152 holding the signal contacts 124. The contact module 122 includes a conductive holder 154 holding the frame assembly 150. The conductive holder 154 defines at least a portion of the shield structure 126. The conductive holder 154 generally surrounds the dielectric body 152 and the signal contacts 124 along substantially the entire length of the signal contacts 124 between the mounting end at the bottom 130 and the mating end at the front 128 to provide electrical shielding.

The conductive holder 154 has a front 156 configured to be loaded into the housing 120 (shown in FIG. 1), a rear 157 opposite the front 156, a bottom 158 which optionally may be adjacent to the circuit board 104 (shown in FIG. 1), and a top 159 generally opposite the bottom 158. The bottom 158 of the conductive holder 154 defines a bottom of the contact module 122 at the bottom 130 of the electrical connector 102. The conductive holder 154 also defines right and left sides 160, 162 of the contact module 122, as viewed from the front.

The conductive holder 154 is fabricated from a conductive material which provides electrical shielding for the contact module 122. For example, the conductive holder 154 may be die-cast, or alternatively stamped and formed, from a metal material. In other alternative embodiments, the holder 154 may be fabricated from a plastic material that has been metalized or coated with a metallic layer. In other embodiments, rather than a conductive holder, the holder 154 may be non-conductive. In other embodiments, the contact module 122 may be provided without the conductive holder 154 altogether.

The signal contacts 124 have mating portions 164 extending forward from the front 156 of the conductive holder 154. The mating portions 164 are configured to be electrically terminated to corresponding mating signal contacts (not shown) when the electrical connector 102 is mated to the mating electrical connector (not shown). In an exemplary embodiment, the signal contacts 124 have mounting portions 165 at opposite ends from the mating portions 164 that extend downward below the bottom 158 of the conductive holder 154. In an exemplary embodiment, the signal contacts 124 in each contact module 122 are arranged as contact pairs 168 configured to transmit differential signals through the contact module 122.

In an exemplary embodiment, the mounting portions 165 include compliant pins 166, which may be referred to as signal pins 166, such as to differentiate from ground pins. In the illustrated embodiment, the compliant pins 166 are eye-of-the-needle pins. The signal pins 166 electrically connect the contact module 122 to the circuit board 104 (shown in FIG. 1). The signal pins 166 are configured to be terminated to the circuit board 104. For example, the signal pins 166 may be received in corresponding plated vias or through-holes of the circuit board 104. The signal pins 166 have enlarged areas 167 that are configured to engage corresponding plated vias of the circuit board 104 by an interference fit to mechanically and electrically couple the signal pins 166 to the circuit board 104. In an exemplary embodiment, the mating portions 164 extend generally perpendicular with respect to the signal pins 166 (for example, horizontally and vertically, respectively)

In an exemplary embodiment, each contact module 122 includes first and second ground shields 176, 178, which define at least a portion of the shield structure 126. The ground shields 176, 178 may be positioned along the interior sides of the conductive holder 154, such as between the conductive holder 154 and the dielectric body 152. For example, the first ground shield 176 may be positioned along the right side 160 of the conductive holder 154 (when viewed from the front), and as such, may be hereinafter referred to as the right ground shield 176. When attached to the conductive holder 154, the right ground shield 176 electrically connects to the conductive holder 154. The second ground shield 178 may be positioned along the left side 162 of the conductive holder 154, and may be hereinafter referred to as the left ground shield 178. When attached to the conductive holder 154, the left ground shield 178 electrically connects to the conductive holder 154. The ground shields 176, 178 are configured to provide electrical shielding for the signal contacts 124. The ground shields 176, 178 electrically connect the contact module 122 to the mating electrical connector, such as to ground shields thereof, thereby electrically commoning the connection between the electrical connector 102 and the mating electrical connector. Optionally, a single ground shield may be used rather than two ground shields. The ground shields 176, 178 may be similar and include similar features and components. As such, the description below may include description of either ground shield, which may be relevant to the other ground shield and like components may be identified with like reference numerals.

Figure 5:
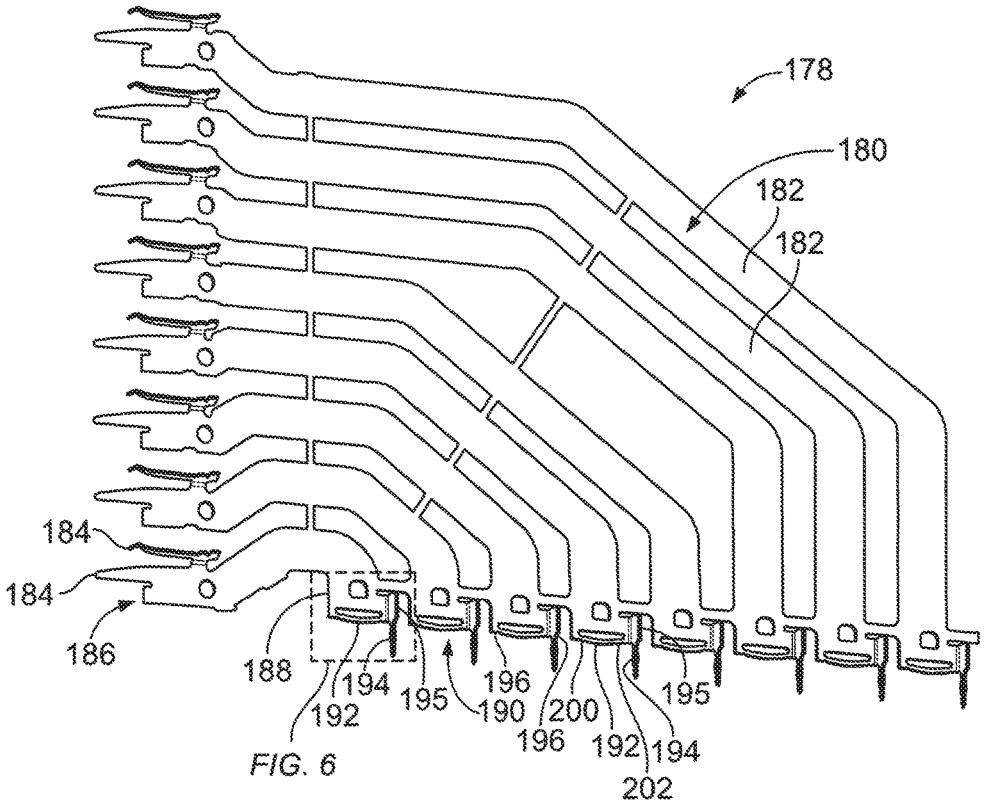
FIG. 5 is a perspective view of a ground shield of the contact module in accordance with an exemplary embodiment.
Figure 6:
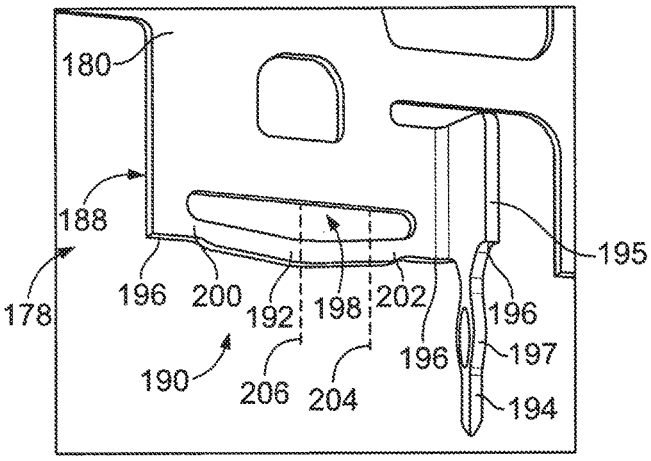
FIG. 6 is an enlarged view of a portion of the ground shield.

FIG. 5 is a perspective view of the ground shield 178. FIG. 6 is an enlarged view of a portion of the ground shield 178 identified by the line 6-6 shown in FIG. 5. The ground shield 178 includes a main body 180 that is generally planar and configured to extend alongside of the dielectric body 152 and the conductive holder 154 (both shown in FIG. 3). In an exemplary embodiment, the ground shield 178 is stamped and formed from a stock piece of metal material.

The main body 180 may include a plurality of strips 182 separated by gaps, which may be interconnected by tie bars between the strips 182. Alternatively, the main body 180 may be a solid sheet without the gaps and strips 182. In other various embodiments, the main body 180 may include tabs bent inward configured to be received in and extend at least partially through the dielectric body 152 (shown in FIG. 3). The ground shield 178 includes grounding beams 184 at a front 186 of the main body 180. The ground shield 176 includes grounding portions 188 at a bottom 190 of the main body 180. The grounding portions 188 provide electrical shielding for the signal contacts 124 (shown in FIG. 3). The grounding portions 188 are configured to be terminated to the circuit board 104 (shown in FIG. 1).

In an exemplary embodiment, each grounding portion 188 includes a surface tab 192 configured to face the circuit board 104 and which may engage and be electrically connected to the mounting face of the circuit board 104. Each grounding portion 188 includes a compliant pin 194, which may be referred to as a ground pin 194, such as to differentiate from the signal pins 166 (shown in FIG. 3). In the illustrated embodiment, the compliant pins 194 are eye-of-the-needle pins. The compliant pins 194 extend from lateral tabs 195, which are bent approximately perpendicular to the main body 180. The lateral tabs 195 allow the compliant pins 194 to be offset from the plane of the main body 180, such as to position the compliant pins 194 in line with the signal contacts 124, as described in further detail below. The lateral tab 195 and corresponding compliant pin 194 are provided at one end of the surface tab 192. The compliant pin 194 electrically connects the ground shield 178 to the circuit board 104. The compliant pin 194 is configured to be terminated to the circuit board 104. For example, the compliant pin 194 may be received in a corresponding plated via or through-hole of the circuit board 104. The compliant pin 194 has an enlarged area 197 having a greater width than other portions of the compliant pin 194 that is configured to engage the corresponding plated via of the circuit board 104 by an interference fit to mechanically and electrically couple the compliant pin 194 to the circuit board 104.

The surface tab 192 is an extension from the main body 180 extending downward therefrom for providing additional shielding below the bottom 190 of the main body 180. The surface tab 192 provides shielding in the space between the main body 180 and the circuit board 104 for shielding portions of the signal contacts 124 otherwise unshielded without the provision of the surface tab 192. For example, the grounding portion 188 includes a base edge 196 defining the bottom 190 of the main body 180. The surface tab 192 extends below the base edge 196 and thus provides shielding below the base edge 196 of the main body 180.

In an exemplary embodiment, the surface tab 192 is a compliant surface tab 192 configured to be deflected, such as against the mounting surface 106 of the circuit board 104. For example, when the contact module 122 is press mounted to the circuit board 104 with the electrical connector 102, the surface tab 192 may interfere with the mounting surface 106 and be pressed upward by the circuit board 104. The grounding portion 188 includes a gap 198 above the surface tab 192. The surface tab 192 is deflectable into the gap 198. The surface tab 192, in the illustrated embodiment, is supported at a first fixed end 200 and a second fixed end 202. The surface tab 192 is a curved or arched beam between the ends 200, 202 below the gap 198. However, in alternative embodiments, the surface tab 192 may be supported at only one of the ends 200 or 202, with the other end 200 or 202 being a free end, such as an embodiment being separated at the dashed line 204 (FIG. 6). In other alternative embodiments, the surface tab 192 may be formed by two opposed tab segments supported at the ends 200, 202, respectively, and facing each other at the center of the surface tab 192, such as an embodiment being separated at the dashed line 206 (FIG. 6).

Returning to FIG. 4, the ground shields 176, 178 are shown in the conductive holder 154 along first and second sides 210, 212 of the dielectric body 152. The grounding portions 188 of the ground shields 176, 178 provide shielding for the pairs of signal contacts 124. For example, one grounding portion 188 of the ground shield 176 cooperates with a corresponding grounding portion 188 of the ground shield 178 to provide shielding on all four sides of the corresponding pair of signal contacts 124. For example, the surface tabs 192 provide shielding along opposite sides of the pair of signal contacts 124 while the compliant pins 194 provide shielding along opposite ends of the pair of signal contacts 124. In the illustrated embodiment, the lateral tabs 195 and the compliant pins 194 of the ground shield 176 are provided forward of the corresponding pair of compliant pins 166 while the lateral tabs 195 and the compliant pins 194 of the ground shield 178 are provided rearward of the corresponding pair of compliant pins 166.

The dielectric body 152 has a mounting edge 214, which may be recessed relative to the bottom 158 of the conductive holder 154 (for example, elevated above the bottom 158), flush with the bottom 158, or extend below the bottom 158. The grounding portions 188, including the compliant pins 194 and the surface tabs 192, extend below the mounting edge 214, such as for mounting to the circuit board 104. The mounting portions 165, including the compliant pins 166, extend below the mounting edge 214 for mounting to the circuit board 104 (shown in FIG. 1). In an exemplary embodiment, each signal contact 124 includes a base edge 216 exposed below the mounting edge 214 or flush with the mounting edge 214. Optionally, the base edges 216 of the signal contacts 124 are generally coplanar with the base edges 196 of the grounding portions 188 of the ground shields 176, 178.

Figure 7:
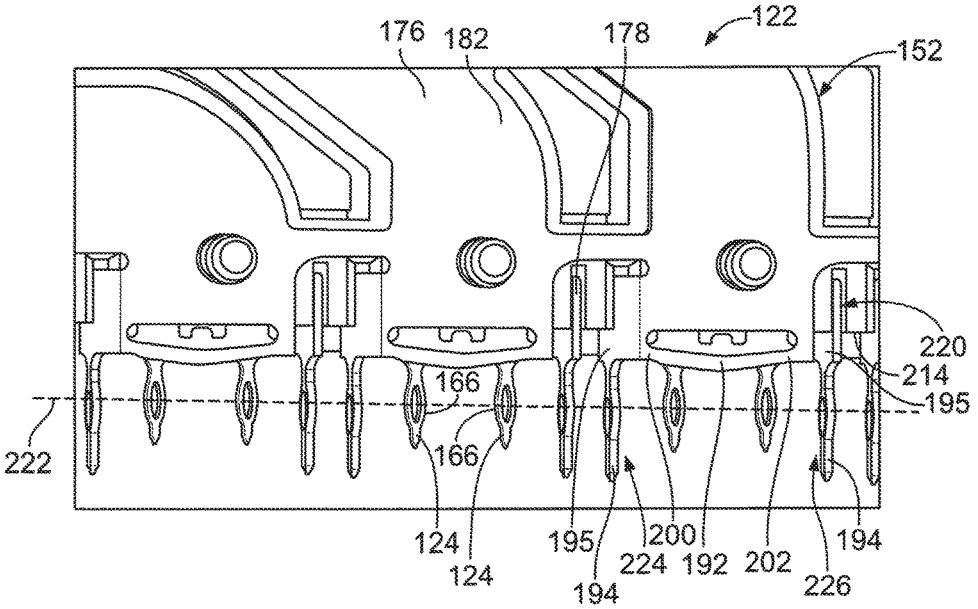
FIG. 7 is a perspective view of a portion of the contact module showing a mounting end thereof.

FIG. 7 is a perspective view of a portion of the contact module 122 showing the mounting end thereof. FIG. 7 shows the ground shields 176, 178 coupled to the dielectric body 152 with the contact holder 154 (shown in FIG. 3) removed to show the ground shield 176. FIG. 7 shows a portion of the frame assembly 150 (FIG. 3) including the dielectric body 152 and the signal contacts 124, which may be part of a leadframe. For example, the signal contacts 124 may be stamped and formed from a leadframe. The dielectric body 152 may be an overmolded frame surrounding portions of the leadframe and the signal contacts 124. Manufacturing processes other than overmolding a leadframe may be utilized to form the frame assembly 150, such as loading signal contacts 124 into a formed dielectric body.

The ground shields 176, 178 may be coupled to posts extending from the dielectric body 152 or to other securing features to position and secure the ground shields 176, 178 to the dielectric body 152. The strips 182 extend along corresponding portions of the dielectric body 152 to cover and provide shielding for the pair of signal contacts 124 passing through such portions of the dielectric body 152. The dielectric body 152 includes slots 220 at the mounting edge 214 that receive corresponding lateral tabs 195 of the ground shields 176, 178. The slots 220 allow positioning of the lateral tabs 195 and the compliant pins 194 in the dielectric body 152 such that the compliant pins 194 of the ground shields 176, 178 are aligned with the compliant pins 166 of the signal contacts 124 along a compliant pin axis 222.

In an exemplary embodiment, the compliant pin 194 associated with the first ground shield 176 is arranged at a forward end 224 of the corresponding pair of signal contacts 124 while the compliant pin 194 associated with the second ground shield 178 is arranged at a rearward end 226 of the corresponding pair of signal contacts 124. Both complaint pins 166 of the signal contacts 124 are positioned between the complaint pins 194 of the first and second ground shields 176, 178. As such, the compliant pins 194 provide electrical shielding forward and rearward of the compliant pins 166. The surface tab 192 associated with the first ground shield 176 is arranged at a first side of the corresponding pair of signal contacts 124 while the surface tab 192 associated with the second ground shield 178 is arranged at an opposite second side of the corresponding pair of signal contacts 124. Both surface tabs 192 span across both signal contacts 124 of the corresponding pair of signal contacts 124. For example, the fixed ends 200, 202 are located outside of (for example, forward of or rearward of) the compliant pins 166. Both complaint pins 166 are positioned between the surface tabs 192 of the first and second ground shields 176, 178. As such, the surface tabs 192 provide electrical shielding along opposite sides of the compliant pins 166.

The surface tabs 192 do not require plated vias in the circuit board 104, and thus there is more room in the circuit board 104 for routing traces between rows of signal vias. As such, the number of layers of the circuit board 104 may be reduced as compared to electrical connectors that have ground shields with ground pins located between rows of signal contacts. Because the compliant pins 194 are in line with the signal contacts 124 and not along the sides of the signal contacts 124 (for example, not in a parallel row), there is additional space in the circuit board 104 for routing the signal traces, such as along both sides of the signal vias as opposed to just one side of the signal vias. The surface tabs 192 are provided to provide shielding along the sides of the signal contacts 124 without needing ground vias in the circuit board 104. The surface tabs 192 provide a similar level of signal integrity performance and shielding as electrical connectors having ground shields with compliant ground pins along the sides of the signal contacts, but without the need for offset ground vias in the circuit board 104.

Figure 8:
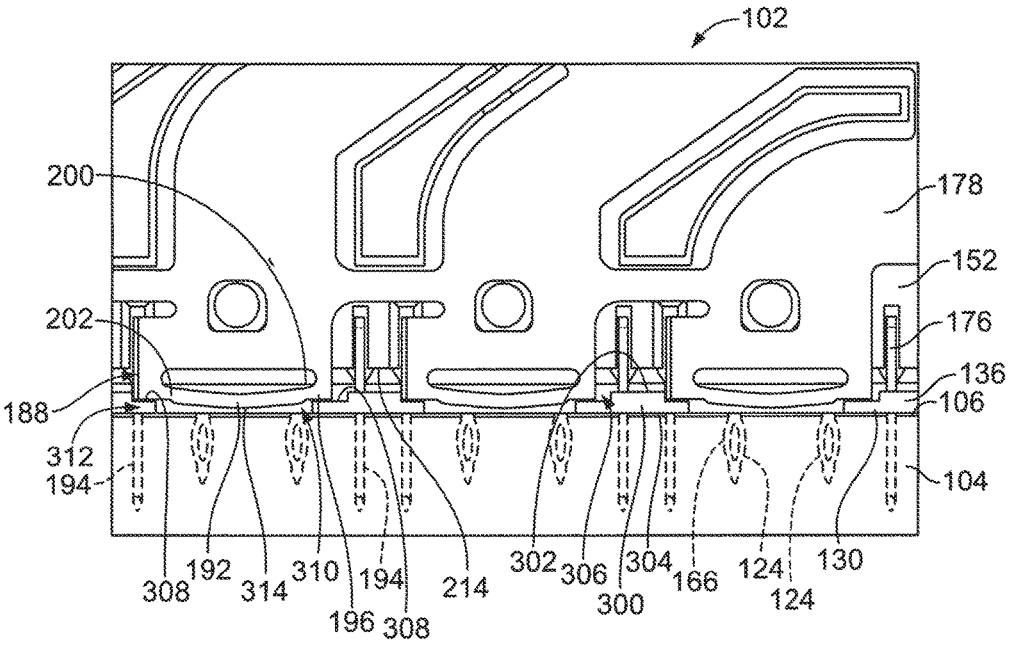
FIG. 8 is a cross-sectional view of a portion of the electrical connector mounted to a circuit board.
Figure 9:
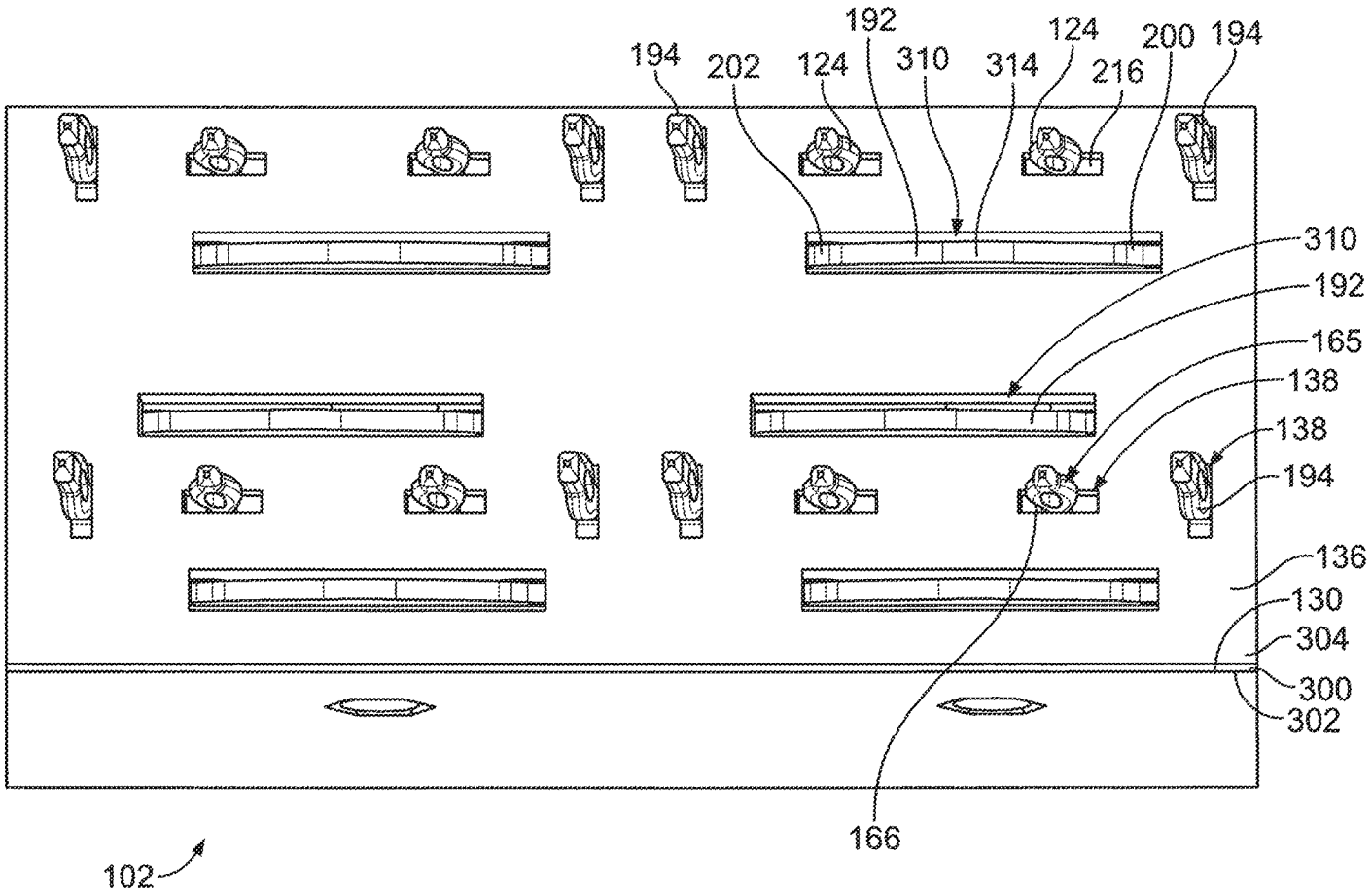
FIG. 9 is a bottom view of a portion of the electrical connector showing a pin spacer in accordance with an exemplary embodiment.

FIG. 8 is a cross-sectional view of a portion of the electrical connector 102 mounted to the circuit board 104. FIG. 9 is a bottom view of a portion of the electrical connector 102 showing the pin spacer 136. FIG. 8 shows the pin spacer 136 at the mounting end of the electrical connector 102, between the mounting surface 106 of the circuit board 104 and the mounting edge 214 of the dielectric body 152. The grounding portions 188 of the ground shield 178 extend from the mounting edge 214 and are received in the pin spacer 136 (FIG. 8). The compliant pins 194 of the ground shields 176, 178 pass through the pin spacer 136 for termination to the circuit board 104. Similarly, the compliant pins 166 of the signal contacts 124 pass through the pin spacer 136 for termination to the circuit board 104.

The pin spacer 136 includes a plate 300 having a top 302 and a bottom 304. The pin spacer 136 includes a plurality of ground contact pockets 306 (FIG. 8) receiving corresponding grounding portions 188 of the ground shields 176, 178. The pin openings 138 (FIG. 9) receiving the compliant pins 194 are open to the ground contact pockets 306. Similarly, the pin spacer 136 includes a plurality of signal contact pockets (not shown) receiving the mounting portions 165 of the signal contacts 124 with the pin openings 138 receiving the compliant pins 166 open to such signal contact pockets. The ground contact pockets 306 have ledges 308 (FIG. 8) recessed below the top 302. The base edges 196 of the grounding portions 188 rest on the ledges 308. For example, the pin spacer 136 is pressed onto the bottom 130 of the electrical connector 102 until the pin spacer 136 bottoms out against the base edges 196 (and the base edges 216 of the signal contacts 124 shown in FIG. 7).

In an exemplary embodiment, the surface tabs 192 of the grounding portions 188 extend below the base edges 196 and below the ledges 308. For example, the ground contact pockets 306 may have channels 310 extending toward the bottom 304 that receive the surface tabs 192. The channels 310 are provided in a space 312 (FIG. 8) between the ledges 308 and the mounting surface 106 of the circuit board 104. For example, the space 312 is defined in the bottom half of the pin spacer 136. The channels 310 may be open at the bottom 304, which may allow the surface tabs 192 to extend entirely through the pin spacer 136. In the illustrated embodiment, the surface tabs 192 are curved and protrude downward into the channels 310 from the fixed ends 200, 202 such that bottom edges 314 of the surface tabs 192 are substantially flush with the bottom 304 of the pin spacer 136. As such, the bottom edges 314 may engage or almost engage the mounting surface 106 of the circuit board 104.

By extending the surface tabs 192 below the base edges 196, the surface tabs 192 provide electrical shielding in the space 312. As such, the surface tabs 192 provide electrical shielding between pairs of the signal contacts 124 in the space 312, an area otherwise devoid of shielding material. For example, compared to a grounding portion extending straight across the ledges 308 (for example, without the surface tab 192), the grounding portion 188 with the surface tab 192 provides improved shielding, such as along the mounting surface 106 of the circuit board 104. While the compliant pins 194 also extend through the space 312, the compliant pins 194 only provide shielding between pairs of the signal contacts 124 within the same row. The surface tabs 192 provide shielding between the pairs of the signal contacts 124 in different rows. The surface tabs 192 do not have pins that need to be received in plated vias in the circuit board 104, and thus there is more room in the circuit board 104 for routing traces between rows of signal vias. The surface tabs 192 provide signal integrity performance and shielding along the sides of the signal contacts 124 without the need for offset ground vias in the circuit board. Optionally, two surface tabs 192 are provided between the rows of signal contacts 124 (for example, one from each contact module).

In an exemplary embodiment, the surface tabs 192 are compliant surface tabs. The compliant surface tabs 192 are deflectable. For example, the complaint surface tabs 192 may be deflected against the mounting surface 106 of the circuit board 104 when interfering with the mounting surface 106 as the electrical connector 102 is press-mounted to the circuit board 104. The surface tabs 192 do not extend into the circuit board 104 and the circuit board 104 does not need plated vias that receive the surface tabs 192. Rather, the surface tabs 192 face or abut against the mounting surface 106 of the circuit board 104. The compliant surface tab 192 may interfere with the mounting surface 106 when the electrical connector 102 is over-pressed against the circuit board 104. For example, the pin spacer 136 may compress during mounting to the circuit board 104 or the base edges 196 may dig into the pin spacer 136 causing the compliant surface tabs 192 to physically engage the mounting surface 106, which would cause deflection of the surface tab 192. In other various embodiments, the compliant surface tabs 192 may be designed to engage the circuit board 104 upon normal loading forces. For example, the compliant surface tabs 192 may be flush with the bottom 304 or may extend beyond the bottom 304 to ensure that the bottom edges 314 interfere with and engage the mounting surface 106 of the circuit board 104, thus filling the entire height of the space 312. The surface tabs 192 may be cantilevered beams configured to engage and deflect against the mounting surface 106 of the circuit board 104.

Figure 10:
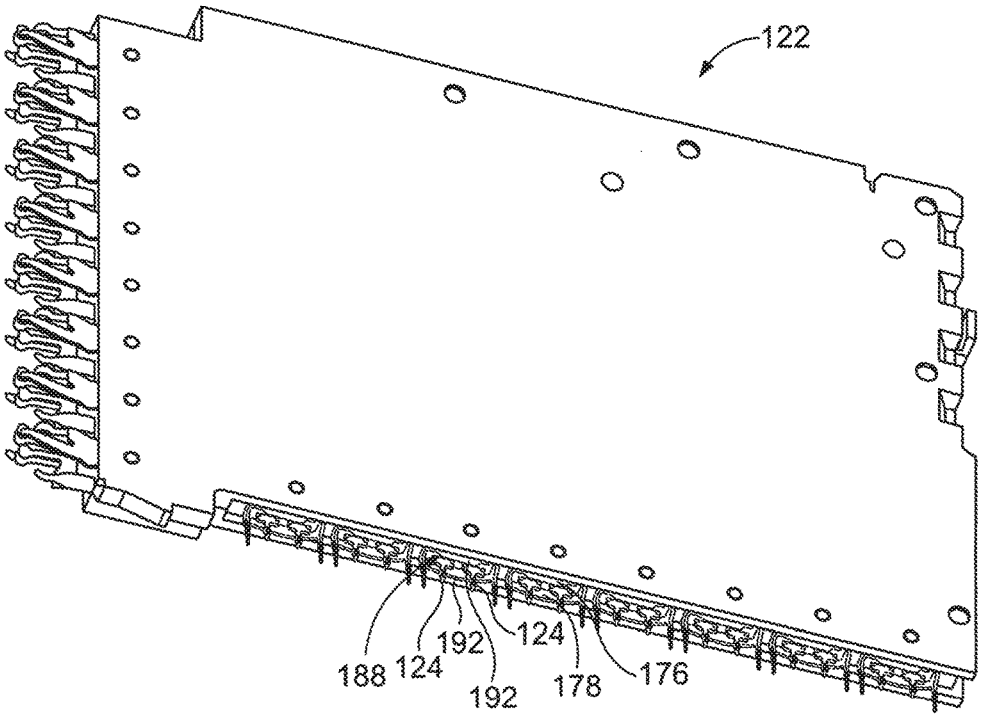
FIG. 10 is a bottom perspective view of a portion of one of the contact modules in accordance with an exemplary embodiment.

FIG. 10 is a bottom perspective view of a portion of one of the contact modules 122 in accordance with an exemplary embodiment. The contact module 122 is shown with solid or non-deflectable surface tabs 192, rather than the deflectable surface tabs shown in FIG. 6. The non-deflectable surface tabs 192 of the grounding portions 188 are provided on both ground shields 176, 178. The grounding portions 188 provide electrical shielding for the signal contacts 124. The grounding portions 188 are configured to be terminated to the circuit board 104 (shown in FIG. 1). The non-deflectable surface tabs 192 face the circuit board 104 and may abut against the circuit board 104 when assembled.

Figure 11:
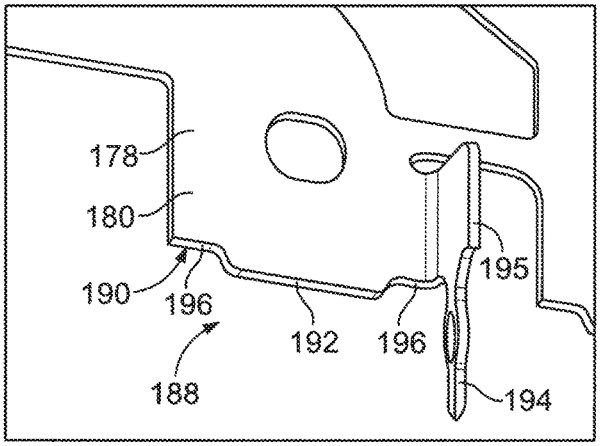
FIG. 11 is a perspective view of a portion of a ground shield showing the surface tab in accordance with an exemplary embodiment.

FIG. 11 is a perspective view of a portion of the ground shield 178 showing the non-deflectable surface tab 192. In an exemplary embodiment, each grounding portion 188 includes one of the surface tabs 192, which may engage and be electrically connected to the mounting face of the circuit board 104. In an exemplary embodiment, each grounding portion 188 includes one of the compliant pins 194, which may be eye-of-the-needle pins, extending from the lateral tabs 195.

The surface tab 192 is an extension from the main body 180 extending downward therefrom for providing additional shielding below the bottom 190 of the main body 180. The surface tab 192 provides shielding in the space between the main body 180 and the circuit board 104 for shielding portions of the signal contacts 124 otherwise unshielded without the provision of the surface tab 192. For example, the surface tab 192 may extend below the base edge 196 and thus provides shielding below the base edge 196 of the main body 180.

Figure 12:
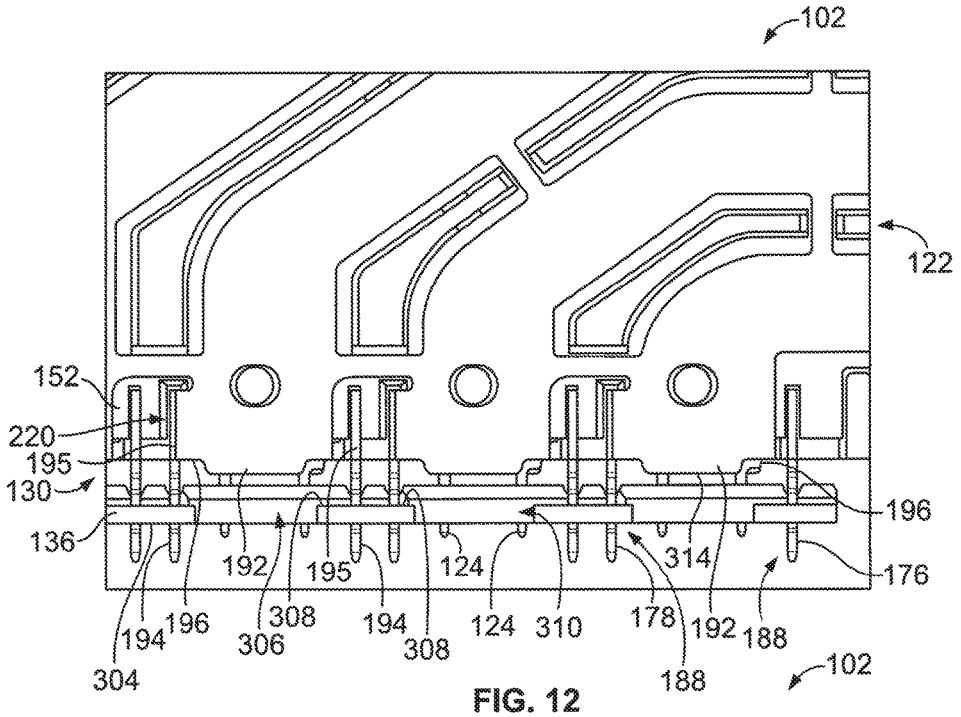
FIG. 12 is a side view of a portion of the electrical connector showing a portion of one of the contact modules with a pin spacer in a pre-staged position.
Figure 13:
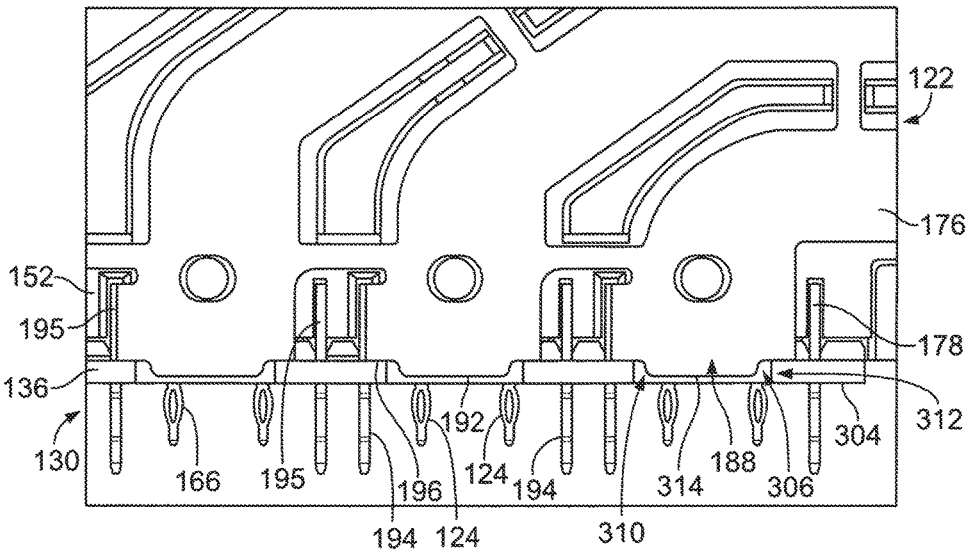
FIG. 13 is a side view of a portion of the electrical connector showing a portion of one of the contact modules with the pin spacer in an assembled position.

FIG. 12 is a side view of a portion of the electrical connector 102 showing a portion of one of the contact modules 122 with the pin spacer 136 in a pre-staged position. FIG. 13 is a side view of a portion of the electrical connector 102 showing a portion of one of the contact modules 122 with the pin spacer 136 in an assembled position. The dielectric body 152 includes the slots 220 that receive corresponding lateral tabs 195 of the ground shields 176, 178. The slots 220 allow positioning of the lateral tabs 195 and the compliant pins 194 in the dielectric body 152 such that the compliant pins 194 of the ground shields 176, 178 are aligned with the compliant pins 166 of the signal contacts 124 along the compliant pin axis.

The surface tab 192 spans across both signal contacts 124 of the corresponding pair of signal contacts 124. For example, the surface tab 192 is generally aligned with and/or extends beyond the forward signal contact 124 and is aligned with and/or extends beyond the rearward signal contact 124. As such, the surface tabs 192 provide electrical shielding along the side of the compliant pins 166.

The ground contact pockets 306 of the pin spacer 136 receive corresponding grounding portions 188. The base edges 196 of the grounding portions 188 rest on the ledges 308. For example, the pin spacer 136 is pressed onto the bottom 130 of the electrical connector 102 until the pin spacer 136 bottoms out against the base edges 196. The surface tabs 192 of the grounding portions 188 extend below the base edges 196 and below the ledges 308, such as in the channels 310 in the bottom half of the pin spacer 136. The channels 310 may be open at the bottom 304, which may allow the surface tabs 192 to extend entirely through the pin spacer 136. In the illustrated embodiment, the surface tabs 192 are curved and protrude downward into the channels 310 such that the bottom edges 314 of the surface tabs 192 are substantially flush with the bottom 304 of the pin spacer 136. As such, the bottom edges 314 may engage or almost engage the mounting surface 106 of the circuit board 104.

By extending the surface tabs 192 below the base edges 196, the surface tabs 192 provide electrical shielding in the space 312. As such, the surface tabs 192 provide electrical shielding between pairs of the signal contacts 124 in the space 312, an area otherwise devoid of shielding material. For example, compared to a grounding portion extending straight across the ledges 308 (for example, without the surface tab 192), the grounding portion 188 with the surface tab 192 provides improved shielding, such as along the mounting surface 106 of the circuit board 104. While the compliant pins 194 also extend through the space 312, the compliant pins 194 only provide shielding between pairs of the signal contacts 124 within the same row. The surface tabs 192 provide shielding between the pairs of the signal contacts 124 in different rows.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

What is claimed is:

1. A contact module comprising:

a dielectric body having a mounting edge extending between first and second sides;

signal contacts being held by the dielectric body, the signal contacts having mounting portions extending from the mounting edge for termination to a circuit board, each mounting portion having a base edge and a compliant pin extending below the base edge, the compliant pins being configured to be received in plated vias of the circuit board; and a ground shield provided at the first side of the dielectric body, the ground shield having a main body defining a plane between first and second sides of the ground shield, the ground shield having grounding portions at the mounting edge of the dielectric body, each grounding portion providing electrical shielding for the corresponding signal contacts, each grounding portion including a base edge and a compliant pin extending below the base edge, the base edge of the grounding portion being generally coplanar with the base edges of the mounting portions of the corresponding signal contacts, the compliant pin of the grounding portion being configured to be received in a corresponding plated via of the circuit board, each grounding portion including a surface tab contained within the plane of the main body of the ground shield between the first and second sides of the ground shield, the surface tab extending below the base edge to at least partially fill a space between the base edge of the grounding portion and a mounting surface of the circuit board such that the surface tab provides electrical shielding for the compliant pins of the signal contacts in the space between the base edge of the signal contacts and the mounting surface of the circuit board.

2. The contact module of claim 1, wherein the surface tab is a compliant surface tab being deflectable against the mounting surface of the circuit board when interfering with the mounting surface as the contact module is press-mounted to the circuit board.

3. The contact module of claim 1, wherein the surface tab spans across the corresponding signal contact or signal contacts associated with the ground shield.

4. The contact module of claim 1, wherein the surface tab is curved between first and second fixed ends.

5. The contact module of claim 1, wherein the surface tab is cantilevered from a fixed end.

6. The contact module of claim 1, wherein the surface tab is a first compliant surface tab, the contact module further comprising a second compliant surface tab opposing the first compliant surface tab, the second compliant surface tab being configured to face the mounting surface of the circuit board, the second compliant surface tab being configured to be deflected against the mounting surface of the circuit board when interfering with the mounting surface as the contact module is press-mounted to the circuit board.

7. The contact module of claim 1, wherein the grounding portion includes a gap above the surface tab, the surface tab being deflectable into the gap.

8. The contact module of claim 1, wherein the grounding portion includes a lateral tab oriented perpendicular with respect to the surface tab, the compliant pin extending from the lateral tab, the lateral tab extending into the dielectric body such that the compliant pin is aligned with the compliant pins of the signal contacts along a compliant pin axis.

9. The contact module of claim 1, wherein the signal contacts are arranged in pairs carrying differential signals and wherein the ground shield is a first ground shield, the contact module further comprising a second ground shield provided at the second side of the dielectric body, the second ground shield having grounding portions at the mounting edge of the dielectric body, each grounding portion of the second ground shield including a compliant pin and a surface tab configured to face the mounting surface of the circuit board, the compliant pin of the first ground shield being arranged at a first end of the pair of signal contacts and the compliant pin of the second ground shield being arranged at an opposite second end of the signal contacts of the corresponding pair of signal contacts, the surface tab of the first ground shield being arranged along a first side of the pair of signal contacts and the surface tab of the second ground shield being arranged along an opposite second side of the pair of signal contacts.

10. The contact module of claim 1, wherein the surface tab is configured to extend at least partially though a pin-spacer holding the compliant pins of the ground shield and the compliant pins of the mounting portions of the signal contacts.

11. A contact module comprising:

a dielectric body having a mounting edge extending between first and second sides;

signal contacts being held by the dielectric body, the signal contacts having mounting portions extending from the mounting edge for termination to a circuit board, the mounting portions including compliant pins configured to be received in plated vias of the circuit board; and a first ground shield provided at the first side of the dielectric body, the first ground shield having grounding portions at the mounting edge of the dielectric body, each grounding portion providing electrical shielding for the corresponding signal contacts, each grounding portion including a compliant pin configured to be received in a corresponding plated via of the circuit board, each grounding portion including a compliant surface tab configured to face a mounting surface of the circuit board, the compliant surface tab being configured to be deflected against the mounting surface of the circuit board when interfering with the mounting surface as the contact module is press-mounted to the circuit board; and a second ground shield provided at the second side of the dielectric body, the second ground shield having grounding portions at the mounting edge of the dielectric body, each grounding portion of the second ground shield including a compliant pin and a compliant surface tab configured to face the mounting surface of the circuit board;

wherein the compliant pin of the first ground shield is arranged at a first end of the corresponding signal contact and the compliant pin of the second ground shield is arranged at an opposite second end of the corresponding contacts, the compliant surface tab of the first ground shield being arranged along a first side of the corresponding signal contact and the compliant surface tab of the second ground shield being arranged along an opposite second side of the corresponding signal contact.

12. The contact module of claim 11, wherein the complaint surface tab spans across the corresponding signal contact or signal contacts associated with the ground shield.

13. The contact module of claim 11, wherein the compliant surface tab is curved between first and second fixed ends.

14. The contact module of claim 11, wherein the complaint surface tab is cantilevered from a fixed end.

15. The contact module of claim 11, wherein the compliant surface tab is a first compliant surface tab, the ground shield comprising a second compliant surface tab opposing the first compliant surface tab, the second compliant surface tab being configured to face the mounting surface of the circuit board, the second compliant surface tab being configured to be deflected against the mounting surface of the circuit board when interfering with the mounting surface as the contact module is press-mounted to the circuit board.

16. The contact module of claim 11, wherein the grounding portion includes a gap above the compliant surface tab, the compliant surface tab being deflectable into the gap.

17. The contact module of claim 11, wherein the grounding portion includes a lateral tab oriented perpendicular to the compliant surface tab, the compliant pin extending from the lateral tab, the lateral tab extending into the dielectric body such that the complaint pin is aligned with the compliant pins of the signal contacts along a compliant pin axis.

18. The contact module of claim 11, wherein the signal contacts are arranged in pairs carrying differential signals, the compliant pin of the first ground shield being arranged at a first end of the pair of signal contacts and the compliant pin of the second ground shield being arranged at an opposite second end of the signal contacts of the corresponding pair of signal contacts, the compliant surface tab of the first ground shield being arranged along a first side of the pair of signal contacts and the compliant surface tab of the second ground shield being arranged along an opposite second side of the pair of signal contacts.

19. The contact module of claim 11, wherein the compliant surface tab is configured to extend at least partially though a pin-spacer holding the compliant pins of the ground shield and the compliant pins of the mounting portions of the signal contacts.

20. An electrical connector comprising:

a housing having a mating end and a back end opposite the mating end, contact modules arranged in a contact module stack received in and extending from the back end of the housing for termination to a circuit board, and a pin spacer arranged at a mounting end of the contact module stack between the mounting end and the circuit board;

wherein each contact module comprises:

a dielectric body having a mounting edge extending between first and second sides;

signal contacts being held by the dielectric body, the signal contacts having mounting portions extending from the mounting edge for termination to a circuit board, each mounting portion having a base edge and a compliant pin extending below the base edge, the compliant pins being configured to be received in plated vias of the circuit board; and a ground shield provided at the first side of the dielectric body, the ground shield having grounding portions at the mounting edge of the dielectric body, each grounding portion providing electrical shielding for the corresponding signal contacts, each grounding portion including a base edge and a compliant pin extending below the base edge, the base edge of the grounding portion being generally coplanar with the base edges of the mounting portions of the corresponding signal contacts, the compliant pin configured to be received in a corresponding plated via of the circuit board, each grounding portion including a surface tab extending below the base edge;

wherein the pin spacer includes a top and a bottom with signal contact openings receiving the compliant pins of the signal contacts and ground contact openings receiving the compliant pins of the grounding portions, the pin spacer having ground contact pockets receiving corresponding surface tabs;

wherein the pin spacer having ledges surrounding the signal contact openings, the ground contact openings and the ground contact pockets, the base edge of each signal contact being supported by a corresponding ledge of the pin spacer, the base edge of each grounding portion being supported by a corresponding ledge of the pin spacer; and wherein the surface tabs extends below the ledge into the ground contact pocket to at least partially fill a space between the base edge of the grounding portion and a mounting surface of the circuit board.

* * * * *